United States Patent [19]

Poteat

[11] 4,341,095

[45] Jul. 27, 1982

[54] STRETCHABLE GARMENT KNIT OF COTTON YARN

[75] Inventor: Dewey E. Poteat, Lenoir, N.C.

[73] Assignee: Alba-Waldensian, Incorporated, Valdese, N.C.

[21] Appl. No.: 146,103

[22] Filed: May 2, 1980

[51] Int. Cl.[3] ..... A41B 9/04

[52] U.S. Cl. ..... 66/177; 2/406; 2/402; 66/189; 66/202

[58] Field of Search ..... 2/406, 407, 409, 239, 2/241, 401, 402; 66/177, 178 A, 189, 202

[56] References Cited

U.S. PATENT DOCUMENTS

| | | | |
|---|---|---|---|
| 568,694 | 9/1896 | Muhlinghaus et al. | 66/202 |
| 1,890,299 | 12/1932 | Mutchlen et al. | 66/177 |
| 2,706,389 | 4/1955 | Garrou et al. | 2/401 X |
| 3,132,497 | 5/1964 | Garrou | 2/239 X |
| 3,477,257 | 11/1969 | Towslee | 66/202 |
| 4,213,312 | 7/1980 | Sajrit et al. | 2/409 X |

*Primary Examiner*—H. Hampton Hunter

*Attorney, Agent, or Firm*—Bell, Seltzer, Park & Gibson

[57] ABSTRACT

This garment is knit exclusively of cotton yarn and has sufficient stretchability and recoverability to properly fit several body sizes. The garment comprises single courses of large stitch loops (courses C-1, C-3 and C-5) of cotton body yarn (C) alternating with single courses of small stitch loops (courses C-2, C-4 and C-6) of cotton body yarn (C) extending throughout the main body portion of the garment. The courses of large stitch loops provide stretchability to the garment and the courses of small stitch loops provide density and opacity to the garment.

6 Claims, 3 Drawing Figures

STRETCHABLE GARMENT KNIT OF COTTON YARN

FIELD OF THE INVENTION

This invention relates generally to a stretchable garment knit exclusively of cotton yarn, and more particularly to such a garment having sufficient stretchability and recoverability to properly fit several body sizes with at least the main body portion of the garment comprising single courses of large stitch loops of cotton body yarn alternating with single courses of small stitch loops of cotton body yarn.

BACKGROUND OF THE INVENTION

It has long been desirable to produce knitted garments having sufficient stretchability and recoverability to properly fit several body sizes and it has been the common practice to produce such garments by knitting the garment of a synthetic yarn which has been textured or crimped to impart stretchability thereto. U.S. Pat. No. 2,706,389 discloses a full-fashioned panty which is knit throughout of such crimped synthetic yarn and the panty blank is shaped during the knitting process to generally conform to the configuration of the lower body of the wearer. The panty disclosed in U.S. Pat. No. 2,706,389 has sufficient stretchability and recoverability to fit several body sizes, however, the crimped synthetic yarn does not provide the panty with the moisture absorbing and comfort characteristics of a panty knit entirely of cotton yarn.

In an effort to provide a stretchable cotton garment, U.S. Pat. No. 3,132,497 discloses several different types of stretchable garments knit exclusively of cotton yarn. According to this patent, the garment blank is initially knit with unusually large or loose stitch loops throughout the main body of the garment and the garment is then treated with a caustic soda solution to swell and shrink the yarn and thereby reduce the garment to the final desired size. The type of garment disclosed in this patent has sufficient elastic or stretchable properties to fit several body sizes. However, it has been found that after wear and laundering, the garment does not return to the shrunken original condition if the garment is hung up to dry and therefore the elastic or stretchable characteristic is lost or greatly reduced. Also, the caustic soda treatment requires an additional step in the manufacturing process and thereby increases the cost of manufacture.

In an attempt to provide stretch and to retain the desirable characteristics of cotton, U.S. Pat. No. 3,477,257 discloses the formation of an elastic fabric by knitting single courses of a cotton yarn alternating with single courses of a crimped synthetic yarn. The courses of crimped synthetic yarn provide stretchability to the fabric and the courses of cotton yarn provide the desirable properties of feel and absorption. However, garments formed of this type of fabric are difficult to dye to a uniform color because of the different affinity for dye of the cotton and crimped synthetic yarns alternating throughout the garment.

SUMMARY OF THE INVENTION

With the foregoing in mind, it is an object of the present invention to provide a stretchable garment knit exclusively of cotton yarn and wherein the garment has the overall appearance of a conventional nonstretchable knitted garment and has sufficient stretchability and recoverability to properly fit several body sizes heretofore requiring garments of different sizes and while retaining the desirable characteristics of comfort and moisture absorption of an all cotton garment. The present garment can be economically manufactured because it does not require extra manufacturing steps and the stretchability and recoverability is retained after wear and laundering.

In accordance with the present invention, the garment is knit with single courses of large stitch loops of cotton body yarn alternating with single courses of small stitch loops of cotton body yarn throughout at least the main portion of the garment. The courses of large stitch loops provide stretchability to the garment and the courses of small stitch loops provide density and opacity to the garment so that the desired amount of stretchability and recoverability is obtained while the desired appearance, comfort and mosture absorbing characteristics are also obtained in the garment.

The garment of the present invention is illustrated as being a full-fashioned panty which is knit by forming successive courses of stitch loops while shaping opposite sides of the garment blank to generally conform to the configuration of the lower portion of the body of the wearer. However, it is to be understood that the present invention can be employed in the knitting of other types of garments, such as men's briefs, leotards, upper body garments, and socks or the like.

The relationship between the size of the single courses of large or long stitch loops of cotton body yarn and the single courses of small or short stitch loops of cotton body yarn will depend upon the gauge of the machine on which the garment is knit as well as the size of the cotton body yarn being knit. Usually, the length of the large or long stitch loops are from about 1.183 to 1.4437 times as long as the small or short stitch loops. For example, it has been found that a satisfactory full-fashioned panty can be knit on a 51 gauge full-fashion machine by using a cotton body yarn of 50/2 count and while forming single courses of large stitch loops about 1.3125 times as long as the single courses of small stitch loops of cotton body yarn.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
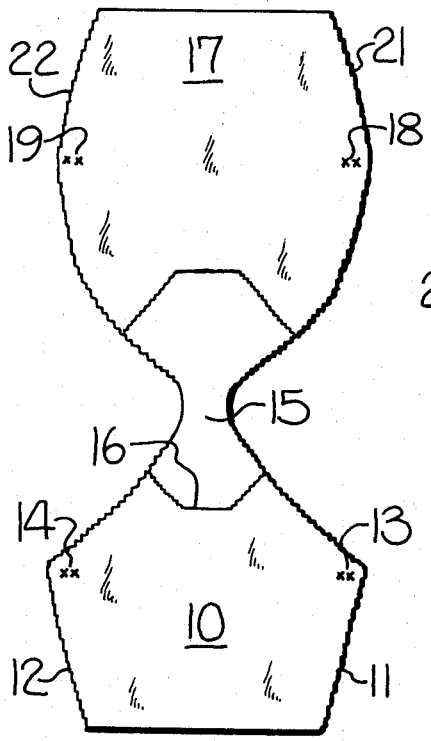
FIG. 1 is a plan view of a full-fashioned panty blank formed in accordance with the present invention and being shaped during the knitting process.
Figure 3:
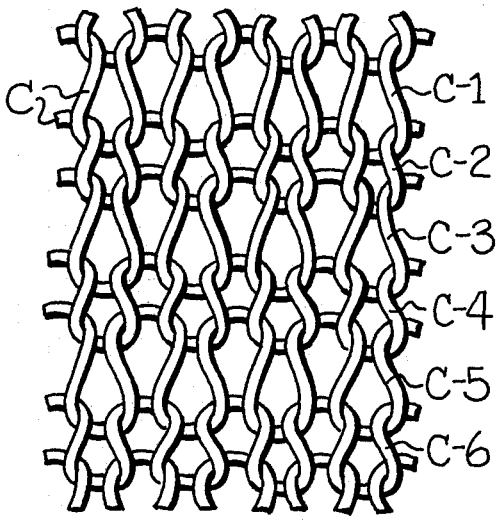
FIG. 3 is a greatly enlarged view of the small area of the fabric taken in the area indicated at 3 in FIG. 2 and illustrating the manner in which the single courses of large stitch loops alternate with the single courses of small stitch loops.

The garment of the present invention is illustrated in FIG. 1 as a panty blank knit on a full-fashion knitting machine and knit exclusively of cotton yarn, as indicated at C in FIG. 3, starting at the bottom of FIG. 1 and knitting successive courses of stitch loops while shaping the opposite sides to generally conform to the configuration of the lower body portion of the wearer. The knitting machine may be of any well-known type, such as the one manufactured by Textile Machine Works and illustrated in detail in U.S. Pat. No. 2,101,048. The stitch regulating mechanism of the machine is set to form single courses of large or long stitch loops of the cotton body yarn C, as illustrated in the odd numbered courses C-1, C-3 and C-5 of FIG. 3, alternating with single courses of small or short stitch loops of the cotton body yarn C, as illustrated in the even numbered courses C-2, C-4 and C-6 in FIG. 3, throughout the length of the panty blank.

Knitting of the panty blank is usually carried out in a "string work" manner wherein the blanks are successively knit with the end of one blank being interconnected with the beginning of the next blank by loose courses and a pull thread so that the blanks can be separated by the knitting machine operator. The knitting of the blank shown in FIG. 1 will be described as being knit from the lower bottom edge to the upper end, however, it is to be understood that the blank could be knit in the opposite direction, if desired. The yarn carrier feeds the cotton yarn C to the needles of the knitting machine in the well-known manner as it moves from one side to the opposite side prior to knitting each successive course. The usual mechanism of the full-fashion machine is employed to control the length of travel of the yarn carrier so that opposite sides of the garment blank are shaped during the knitting process. Starting at the lower end of the blank in FIG. 1, the yarn carrier gradually increases the length of travel during the knitting of a front panel 10 so that opposite side edges 11, 12 are gradually stepped outwardly in a widening operation. It is preferred that the usual narrowing points of the machine transfer stitch loops inwardly adjacent each side of the front panel, as indicated at 13, 14 to form "narrowing marks" to aid the sewing machine operator, in a manner to be presently described.

Upon the completion of the knitting of the front panel 10, the knitting of an integral crotch area 15 begins and the length of travel of the yarn carrier is gradually reduced in a narrowing operation. It is preferred that a second yarn carrier be activated to knit a cotton reinforcing yarn in plated relationship with the cotton body yarn to provide a reinforced crotch area 16. The length of travel of the second yarn carrier is preferably gradually increased to a point where the reinforcing cotton yarn extends from one side of the blank to the other, as illustrated in the lower portion of FIG. 1. In the medial portion of the crotch area 15, both the body yarn carrier and the reinforcing yarn carrier traverse the same width to form a few courses of the same length and then the yarn carriers gradually increase in length in a gradual widening operation to knit the second portion of the crotch area 15. The reinforcing yarn carrier gradually decreases its length of traverse during the upper portion of the crotch area 15 and is then finally removed at the upper end of the reinforced area 16, as illustrated in the upper portion of FIG. 1, while the body yarn carrier continues the widening operation up to the lower end of a rear panel 17.

Before beginning the knitting of the rear panel 17, the narrowing points again form narrowing marks 18, 19, adjacent opposite sides of the blank to aid the sewing operator, in a manner to be presently described. During the knitting of the rear panel 17, the length of travel of the yarn carrier is gradually reduced in a narrowing operation so that opposite sides 21, 22 of the blank are stepped inwardly until the knitting of the blank is completed, at the upper end of the blank shown in FIG. 1.

Figure 2:
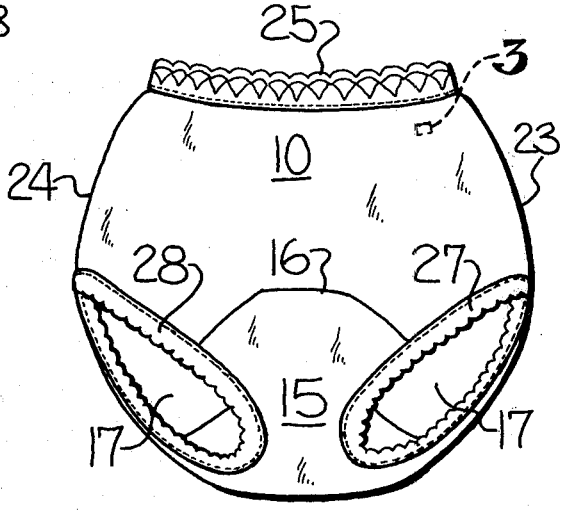
FIG. 2 is a front elevational view of a completed full-fashioned panty formed from the blank shown in FIG. 1.

The panty is then completed by seaming together the corresponding sides 11, 21 and 12, 22 of the respective front panel 10 and rear panel 17 to form opposite side seams 23, 24 (FIG. 2). The narrowing marks 13, 14 and 18, 19 serve as a guide for the sewing machine operator to properly align the sides 11, 21 and 12, 22 for seaming. A suitable elastic waistband 25 is then attached to the ends of the front panel 10 and rear panel 17 and elastic bands 27, 28 are suitably secured around the leg openings at opposite sides of the crotch area 15. The completed panty is then submitted to the usual finishing process, which usually includes washing, dyeing and boarding.

As a specific, but nonlimiting example, it has been found that a stretchable panty with sufficient stretchability to properly fit sizes 4 through 8 can be knit in accordance with the present invention on a 51 gauge full-fashion knitting machine by using a 50/2 count cotton yarn as the body yarn C and a 50/1 count cotton yarn as the reinforcing yarn in the crotch area. The single courses of large or long stitch loops (courses C-1, C-3 and C-5) are knit with a length of from about 1.1813 to 1.4437 times as long as the single courses of small or short stitch loops (courses C-2, C-4 and C-5) and with the large stitch loops preferably being about 1.3125 times as long as the small stitch loops.

During the knitting of the panty blanks, the blanks are periodically checked for uniformity on a Rolande stretch machine of the type manufactured by Fidelity Machine Company and illustrated in U.S. Pat. No. 2,117,402. The blank is checked by clamping spaced-apart portions of the blank between plates on the machine and with the fabric extending in a walewise direction between the two clamping plates. One plate is then moved away from the other plate until a "full stretch" condition is obtained with a weighted arm being raised to a predetermined level. Then, the number of courses in one inch of fabric is counted. It has been found that a satisfactory stretch is obtained in the panty when 18 to 19, preferably 18½, courses per inch are present in the tested blank.

The garment of the present invention has the overall appearance of a conventional nonstretchable knitted garment of the type heretofore knit in several different sizes. Surprisingly, the garment of the present invention has sufficient stretchability and recoverability to properly fit several body sizes and the single courses of large stitch loops of cotton body yarn provide stretchability to the garment while the single courses of small stitch loops of cotton body yarn provide density and opacity to the garment. The garment of the present invention is knit exclusively of cotton yarn so that it is provided with the desirable appearance, comfort and moisture absorbing characteristics of a cotton garment and additionally provides the desirable stretchable characteristics of garments of the type normally knit of some type of crimped synthetic yarn. The present garment retains its stretchability and recoverability after wear and laundering and does not require any special washing and drying procedure.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A garment knit exclusively of the same size and type of cotton body yarn in successive courses of stitch loops and shaped to generally conform to the configuration of that portion of the body on which the garment is to be worn, said garment having the overall appearance of a conventional nonstretchable knitted garment and being characterized by having sufficient stretchability and recoverability to properly fit several body sizes heretofore requiring garments of different sizes, said garment comprising single courses of large stitch loops of said cotton body yarn alternating with single courses of small stitch loops of said cotton body yarn throughout at least the main body portion of said garment, said large stitch loops being from about 1.1813 to 1.4437 times as long as said small stitch loops, and wherein the courses of large stitch loops provide stretchability to said garment and the courses of small stitch loops provide density and opacity to said garment.

2. A garment according to claim 1 wherein said garment comprises a full-fashioned panty having a body portion including interconnected front and rear panels and leg openings therein.

3. A garment according to claim 2 wherein said full-fashioned panty is 51 gauge and said courses of large and small stitch loops are knit of 50/2 count cotton yarn.

4. A garment according to claim 3 wherein the length of said large stitch loops of cotton body yarn are about 1.3125 times as long as said small stitch loops of cotton body yarn.

5. A garment according to claim 2 including a crotch area extending between said leg openings, and wherein a cotton reinforcing yarn is knit in plated relationship with said cotton body yarn in said crotch area.

6. A garment according to claim 3 including a crotch area extending between said leg openings, and wherein a 50/1 count cotton reinforcing yarn is knit in plated relationship with said 50/2 count cotton body yarn in said crotch area.

* * * * *